US006345743B1

(12) United States Patent
Dellamar

(10) Patent No.: US 6,345,743 B1
(45) Date of Patent: Feb. 12, 2002

(54) NEEDLE ORGANIZER SYSTEM

(76) Inventor: Ursula D. Dellamar, 1310 25th St., Ogden, UT (US) 84401

( * ) Notice: Subject to any disclaimer, the term of this patent is extended or adjusted under 35 U.S.C. 154(b) by 0 days.

(21) Appl. No.: 09/904,719

(22) Filed: Jul. 13, 2001

(51) Int. Cl.[7] ..... A41M 31/00
(52) U.S. Cl. ..... 223/109 R
(58) Field of Search ..... 223/106, 108, 223/109 R, 1; 206/227

(56) References Cited

U.S. PATENT DOCUMENTS

| | | | | | |
|---|---|---|---|---|---|
| 245,653 | A | | 8/1881 | Naramore | |
| 1,445,569 | A | | 2/1923 | Tiffany | |
| 2,540,340 | A | * | 2/1951 | Linblade | 206/380 |
| 2,642,211 | A | | 6/1953 | Yingling | |
| 3,884,412 | A | * | 5/1975 | Price | 206/380 |
| 4,319,703 | A | * | 3/1982 | Gann | 223/106 |
| 4,478,333 | A | * | 10/1984 | Dalbo et al. | 206/380 |
| 4,524,891 | A | | 6/1985 | Silva | |
| 4,561,574 | A | | 12/1985 | Brown | |
| 4,664,302 | A | * | 5/1987 | Dalbo et al. | 223/109 R |
| D304,441 | S | | 11/1989 | Edmounds | |

* cited by examiner

*Primary Examiner*—Bibhu Mohanty

(57) ABSTRACT

A needle organizer system for storing and organizing threaded needles for cross-stitch projects. The needle organizer system includes a batting member used for providing a cushioned barrier for safely holding a point of a needle, a covering member enveloping the batting member and supporting the needle when the needle is inserted through the covering member and into the batting member, a backing member for providing rigidity to the needle organizer system, and a front member coupled to the backing member such that the batting member and the covering member are substantially enveloped by the backing member and the front member.

7 Claims, 1 Drawing Sheet

NEEDLE ORGANIZER SYSTEM

BACKGROUND OF THE INVENTION

1. Field of the Invention

The present invention relates to pin cushions and more particularly pertains to a new needle organizer system for storing and organizing threaded needles for cross-stitch projects.

2. Description of the Prior Art

The use of pin cushions is known in the prior art. More specifically, pin cushions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,642,211; U.S. Pat. No. 4,561,574; U.S. Pat. No. 4,524,891; U.S. Pat. No. 245,653; U.S. Pat. No. 1,445,569; and U.S. Pat. No. Des. 304,441.

While these devices fulfill their respective, particular objectives and requirements, the aforementioned patents do not disclose a new needle organizer system. The inventive device includes a batting member used for providing a cushioned barrier for safely holding a point of a needle, a covering member enveloping the batting member and supporting the needle when the needle is inserted through the covering member and into the batting member, a backing member for providing rigidity to the needle organizer system, and a front member coupled to the backing member such that the batting member and the covering member are substantially enveloped by the backing member and the front member.

In these respects, the needle organizer system according to the present invention substantially departs from the conventional concepts and designs of the prior art, and in so doing provides an apparatus primarily developed for the purpose of storing and organizing threaded needles for cross-stitch projects.

SUMMARY OF THE INVENTION

In view of the foregoing disadvantages inherent in the known types of pin cushions now present in the prior art, the present invention provides a new needle organizer system construction wherein the same can be utilized for storing and organizing threaded needles for cross-stitch projects.

The general purpose of the present invention, which will be described subsequently in greater detail, is to provide a new needle organizer system apparatus and method which has many of the advantages of the pin cushions mentioned heretofore and many novel features that result in a new needle organizer system which is not anticipated, rendered obvious, suggested, or even implied by any of the prior art pin cushions, either alone or in any combination thereof.

To attain this, the present invention generally comprises a batting member used for providing a cushioned barrier for safely holding a point of a needle, a covering member enveloping the batting member and supporting the needle when the needle is inserted through the covering member and into the batting member, a backing member for providing rigidity to the needle organizer system, and a front member coupled to the backing member such that the batting member and the covering member are substantially enveloped by the backing member and the front member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new needle organizer system apparatus and method which has many of the advantages of the pin cushions mentioned heretofore and many novel features that result in a new needle organizer system which is not anticipated, rendered obvious, suggested, or even implied by any of the prior art pin cushions, either alone or in any combination thereof.

It is another object of the present invention to provide a new needle organizer system which may be easily and efficiently manufactured and marketed.

It is a further object of the present invention to provide a new needle organizer system which is of a durable and reliable construction.

An even further object of the present invention is to provide a new needle organizer system which is susceptible of a low cost of manufacture with regard to both materials and labor, and which accordingly is then susceptible of low prices of sale to the consuming public, thereby making such needle organizer system economically available to the buying public.

Still yet another object of the present invention is to provide a new needle organizer system which provides in the apparatuses and methods of the prior art some of the advantages thereof, while simultaneously overcoming some of the disadvantages normally associated therewith.

Still another object of the present invention is to provide a new needle organizer system for storing and organizing threaded needles for cross-stitch projects.

Yet another object of the present invention is to provide a new needle organizer system which includes a batting member used for providing a cushioned barrier for safely holding a point of a needle, a covering member enveloping the batting member and supporting the needle when the needle is inserted through the covering member and into the batting member, a backing member for providing rigidity to the needle organizer system, and a front member coupled to the backing member such that the batting member and the covering member are substantially enveloped by the backing member and the front member.

Still yet another object of the present invention is to provide a new needle organizer system that makes large cross-stitch projects easier to complete.

Even still another object of the present invention is to provide a new needle organizer system that works with any cross-stitch kit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
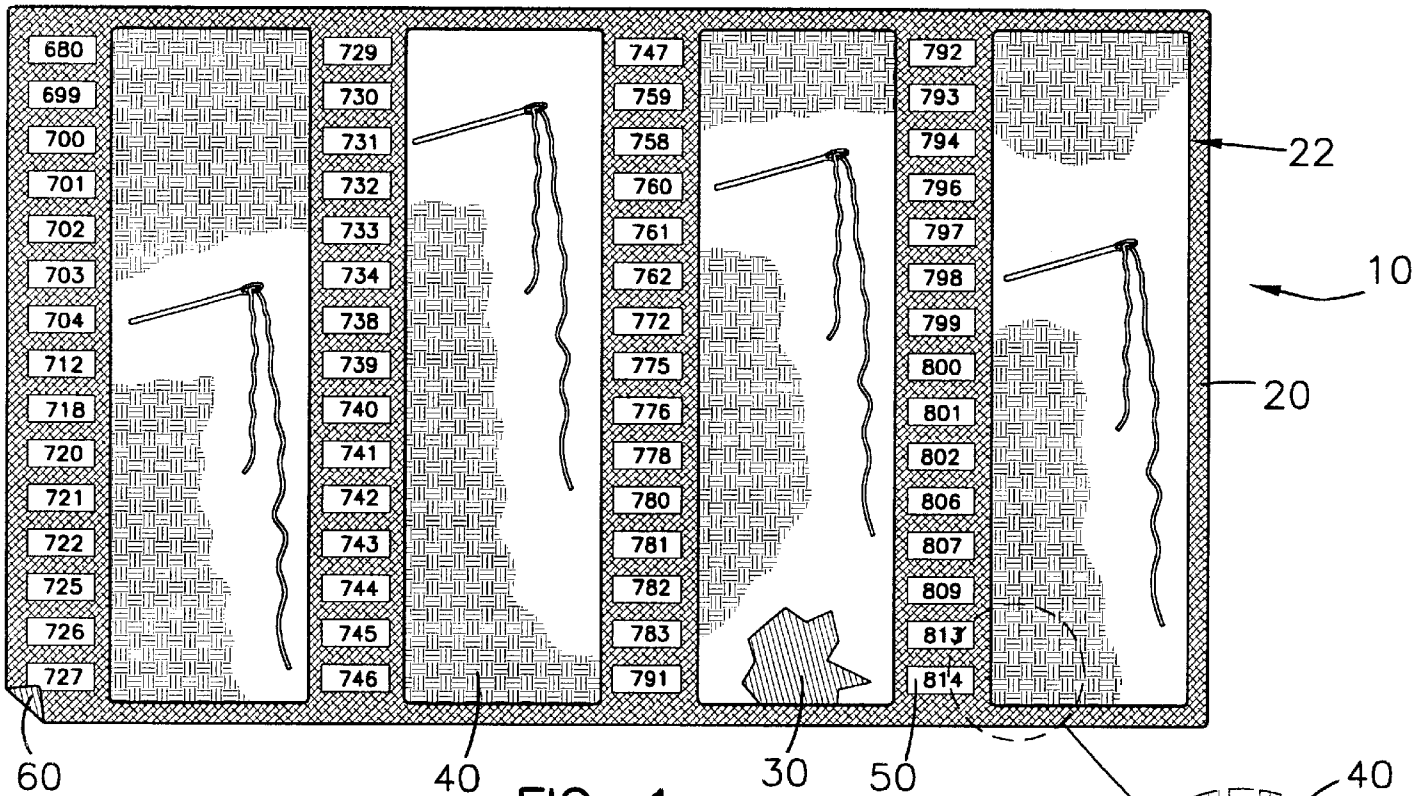
FIG. 1 is a schematic front view of a new needle organizer system according to the present invention.
Figure 2:
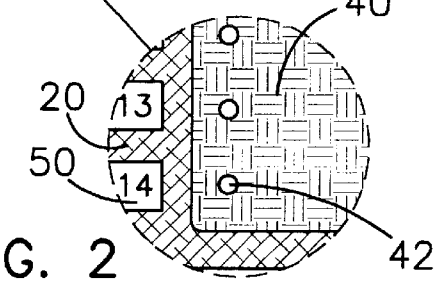
FIG. 2 is a schematic detail view of the covering member and aperture of the present invention.

With reference now to the drawings, and in particular to FIGS. 1 through 2 thereof, a new needle organizer system embodying the principles and concepts of the present invention and generally designated by the reference numeral 10 will be described.

As best illustrated in FIGS. 1 through 2, the needle organizer system 10 generally comprises a batting member 30, a covering member 40, a backing member 60, a front member 20, and a plurality of label members 50.

The batting member 30 is used for providing a cushioned barrier for safely holding a point of a needle.

The covering member 40 envelops the batting member 30. The covering member 40 is used for supporting the needle when the needle is inserted through the covering member 40 and into the batting member 30. The covering member 40 includes a plurality of apertures 42 for receiving a needle.

The backing member 60 provides rigidity to the needle organizer system 10.

The front member 20 is coupled to the backing member 60 such that the batting member 30 and the covering member 40 are substantially enveloped by the backing member 60 and the front member 20. The front member includes four cutouts 22 for providing access to the covering member 40. Each one of the four cutouts 22 is substantially rectangular.

Each one of the plurality of label members 50 can be coupled to the front member 20. Each one of the label members 50 corresponds to a color of floss used in a cross-stitch project.

The needle organizer system 10 has a length of approximately 10 inches and a width of approximately 8 ½ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A needle organizer system for use in cross-stitch projects comprising:

a batting member used for providing a cushioned barrier for safely holding a point of a needle;

a covering member enveloping said batting member, said covering member for supporting the needle when the needle is inserted through said covering member and into said batting member;

a backing member for providing rigidity to said needle organizer system; and a front member coupled to said backing member such that said batting member and said covering member are substantially enveloped by said backing member and said front member.

2. The needle organizer system of claim 1, wherein said front member has at least one cutout providing access to said covering member.

3. The needle organizer system of claim 1, wherein said front member has four cutouts for providing access to said covering member, each one of said four cutouts being substantially rectangular.

4. The needle organizer system of claim 2 further comprising:

a plurality of label members, each one of said label members being couplable to said front member, each one of said label members corresponding to a color of floss used in a cross-stitch project.

5. The needle organizer system of claim 2, wherein said needle organizer system has a length of approximately 10 inches and a width of approximately 8 ½ inches.

6. The needle organizer system of claim 2, wherein said covering member has a plurality of apertures for receiving a needle.

7. A needle organizer system for use in cross-stitch projects comprising:

a batting member used for providing a cushioned barrier for safely holding a point of a needle;

a covering member enveloping said batting member, said covering member for supporting the needle when the needle is inserted through said covering member and into said batting member;

said covering member having a plurality of apertures for receiving a needle;

a backing member for providing rigidity to said needle organizer system;

a front member coupled to said backing member such that said batting member and said covering member are substantially enveloped by said backing member and said front member;

said front member having four cutouts for providing access to said covering member, each one of said four cutouts being substantially rectangular;

a plurality of label members, each one of said label members being couplable to said front member, each one of said label members corresponding to a color of floss used in a cross-stitch project; and said needle organizer system has a length of approximately 10 inches and a width of approximately 8 ½ inches.

* * * * *